US008939077B2

(12) United States Patent
Kumagai

(10) Patent No.: US 8,939,077 B2
(45) Date of Patent: Jan. 27, 2015

(54) WIPING DEVICE

(75) Inventor: Norihiro Kumagai, Ibaraki (JP)

(73) Assignee: Komori Corporation, Tokyo (JP)

( * ) Notice: Subject to any disclaimer, the term of this patent is extended or adjusted under 35 U.S.C. 154(b) by 156 days.

(21) Appl. No.: 13/570,200

(22) Filed: Aug. 8, 2012

(65) Prior Publication Data

US 2013/0042773 A1 Feb. 21, 2013

(30) Foreign Application Priority Data

Aug. 15, 2011 (JP) ..... 2011-177467

(51) Int. Cl.
*B41F 9/16* (2006.01)
*B41F 9/10* (2006.01)
*B41F 35/02* (2006.01)

(52) U.S. Cl.
CPC ..... *B41F 9/1018* (2013.01); *B41F 35/02* (2013.01); *B41F 9/16* (2013.01); *B41P 2235/26* (2013.01); *B41P 2235/31* (2013.01)
USPC ..... 101/167; 101/155; 101/425; 210/712; 210/805

(58) Field of Classification Search
USPC ..... 101/155, 157, 167, 169, 423, 425; 210/712, 805
See application file for complete search history.

(56) References Cited

U.S. PATENT DOCUMENTS 5,201,943 A * 4/1993 Monnerat ..... 106/31.13
5,816,163 A 10/1998 Achelpohl et al.
5,855,787 A * 1/1999 Giori ..... 210/651
6,341,556 B1 * 1/2002 Endo ..... 101/167
6,485,653 B1 * 11/2002 Martini ..... 210/723
6,547,970 B1 * 4/2003 Shinoda ..... 210/710
2003/0029805 A1 2/2003 Martini
2005/0199148 A1 * 9/2005 Schaede ..... 101/425

FOREIGN PATENT DOCUMENTS

| | | | |
|---|---|---|---|
| CN | 1160639 | A | 10/1997 |
| CN | 101421107 | A | 4/2009 |
| GB | 1043775 | | 9/1966 |
| JP | 55-18196 | | 4/1980 |
| JP | 10-337854 | | 12/1998 |
| JP | H10-337855 | A | 12/1998 |
| JP | 2000-127349 | A | 5/2000 |
| JP | 2000-202984 | A | 7/2000 |
| JP | 2001-104994 | A | 4/2001 |
| WO | WO 2007/116353 | A1 | 10/2007 |

* cited by examiner

*Primary Examiner* — Leslie J Evanisko
(74) *Attorney, Agent, or Firm* — Blakely Sokoloff Taylor & Zafman

(57) ABSTRACT

A wiping device includes an intaglio cylinder, a cylinder cleaning device, and a wiping liquid supply device. The intaglio cylinder is rotatably supported. The cylinder cleaning device removes excess ink adhered to an outer surface of the intaglio cylinder. The wiping liquid supply device supplies a wiping liquid for cleaning to the cylinder cleaning device. The wiping liquid supply device includes a waste liquid tank, a new liquid tank, a first pump, and second pump. The waste liquid tank stores a waste wiping liquid discharged from the cylinder cleaning device. The new liquid tank stores a clean wiping liquid. The first pump supplies the clean wiping liquid from the new liquid tank to the cylinder cleaning device. The second pump supplies a supernatant liquid of the waste wiping liquid stored in the waste liquid tank and separated into a precipitate and the supernatant liquid to the cylinder cleaning device.

5 Claims, 2 Drawing Sheets

WIPING DEVICE

BACKGROUND OF THE INVENTION

The present invention relates to a wiping device for removing excess ink and, more particularly, to a wiping device suitably usable in an intaglio printing press.

Generally, in an intaglio printing press, as described in Japanese Patent Laid-Open No. 2000-127349 (literature 1), an inking device transfers ink to the surface of an intaglio plate attached to the outer surface of an intaglio cylinder, and a wiping device removes, out of the transferred ink, excess ink that is adhered to parts other than the image portions. Then, the ink remaining on the image portions of the intaglio plate surface is transferred to a sheet that passes between the intaglio cylinder and an impression cylinder, thereby performing printing.

The conventional wiping device includes a wiping roller that rotates in contact with the intaglio plate surface on the intaglio cylinder so as to wipe excess ink on the intaglio plate surface, a wiping roller cleaning member such as a brush or blade for cleaning the ink adhered to the wiping roller, and a liquid tank capable of storing a wiping liquid.

When cleaning the wiping roller, the above-described wiping device uses a wiping liquid together with the wiping roller cleaning member. The wiping roller is cleaned by the ink solvency of the wiping liquid and the wiping action or scraping action of the wiping roller cleaning member.

In the intaglio printing press, intaglio ink having properties different from those of ink for an offset printing press is used. In addition, the intaglio plate surface wiping effect by the wiping roller needs to be maintained. It is therefore necessary to properly remove the intaglio ink on the wiping roller. For this purpose, caustic soda that is a strong alkali is used as the wiping liquid, as described in Japanese Patent Laid-Open No. 10-337855 (literature 2).

Furthermore, Japanese Patent Laid-Open No. 2001-104994 (literature 3) proposes a wiping liquid processing method and apparatus for filtering a wiping liquid used so as to newly generate a wiping liquid having predetermined properties.

However, the wiping liquid processing method of literature 3 requires a predetermined number of processing steps until a wiping liquid having specific properties is regenerated, and needs a dedicated apparatus to reuse the wiping liquid. It is therefore impossible to easily and efficiently perform intaglio cylinder cleaning processing by the wiping roller at low cost.

SUMMARY OF THE INVENTION

It is an object of the present invention to provide a wiping device capable of efficiently cleaning an intaglio cylinder by a simple arrangement.

In order to achieve the above object, according to the present invention, there is provided a wiping device comprising an intaglio cylinder rotatably supported, a cylinder cleaning device that removes excess ink adhered to an outer surface of the intaglio cylinder, and a wiping liquid supply device that supplies a wiping liquid for cleaning to the cylinder cleaning device, the wiping liquid supply device comprising a waste liquid tank that stores a waste wiping liquid discharged from the cylinder cleaning device, a new liquid tank that stores a clean wiping liquid, a first pump that supplies the clean wiping liquid from the new liquid tank to the cylinder cleaning device, and a second pump that supplies a supernatant liquid of the waste wiping liquid stored in the waste liquid tank and separated into a precipitate and the supernatant liquid to the cylinder cleaning device.

According to the present invention, in addition to supply of a wiping liquid from a new liquid storage unit for storing an unused wiping liquid to the wiping device, a supernatant liquid of a waste wiping liquid stored in a waste liquid storage unit for storing a used and collected wiping liquid is supplied to the wiping device. This enables to reuse the wiping liquid used and also efficiently clean the intaglio cylinder without needing any reprocessing step and device.

DESCRIPTION OF THE PREFERRED EMBODIMENTS

Details of the present invention will now be described with reference to the accompanying drawings.

(1) Arrangement of Intaglio Printing Press

Figure 1:
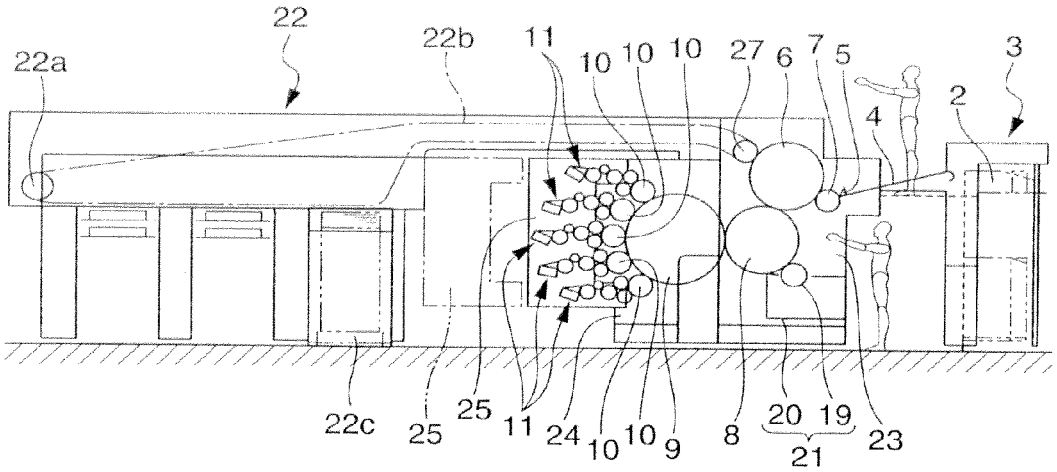
FIG. 1 is a side view showing the arrangement of an intaglio printing press according to an embodiment of the present invention.

In an intaglio printing press as shown in FIG. 1, a sheet feeding device 3 serves as a sheet supply device in which paper sheets 2 serving as sheets are stacked. A feeder board 4 that conveys the paper sheet 2 fed from the upper layer one by one by the sucker mechanism of the sheet feeding device 3 communicates with the sheet feeding device 3. A swing arm shaft pregripper 5 that grips the paper sheet 2 on the feeder board 4 and swings is disposed on the feeder board 4.

An impression cylinder 6 serving as a triple-size cylinder having three grippers disposed at equal intervals along the circumferential direction communicates with the swing arm shaft pregripper 5 via a transfer cylinder 7 facing the impression cylinder 6. The impression cylinder 6 and the transfer cylinder 7 are rotatably supported by a pair of frames. The transfer cylinder 7 is provided with grippers similar to those of the impression cylinder 6. The paper sheet 2 transferred from the swing arm shaft pregripper 5 is released from the grippers of the transfer cylinder 7 and gripped by those of the impression cylinder 6.

An intaglio cylinder 8 serving as a triple-size cylinder rotatably supported by a pair of frames 23 and having three intaglio plates attached along the circumferential direction faces the impression cylinder 6. An ink collecting cylinder 9 serving as a quadruple-size cylinder with four rubber blankets attached along the circumferential direction faces the intaglio cylinder 8. The ink collecting cylinder 9 is rotatably supported by a pair of frames 24.

Five pattern rollers (chevron cylinders) 10 that are single cylinders having a circumferential length corresponding to the length of the blankets of the impression cylinder 6 or the intaglio plate surface of the intaglio cylinder 8 face the ink collecting cylinder 9 in the circumferential direction. Each pattern roller 10 is rotatably supported by the pair of frames 24.

Five ink supply devices 11 corresponding to the pattern rollers 10 are arranged in an inker 25 movably supported between a position indicated by the solid line and a position indicated by the alternate long and two short dashed line in FIG. 1. The ink supply devices 11 include ink fountains (not shown) filled with inks different from each other. The color inks from the ink fountains are supplied to the ink collecting cylinder 9 via the roller groups and the pattern rollers 10. That is, in the intaglio printing press, five pairs of pattern rollers 10 and ink supply devices 11 are disposed for the ink collecting cylinder 9 that is a quadruple-size cylinder.

A delivery cylinder 27 faces the impression cylinder 6. One sprocket (not shown) of a delivery device 22 is coaxially provided for the delivery cylinder 27. A pair of delivery chains 22*b* extend between the one sprocket (not shown) and the other sprocket 22*a* provided at the rear end of the delivery device 22. Delivery grippers (not shown) are attached to the delivery chains 22*b* at a predetermined interval. A plurality of delivery trays 22*c* each serving as a discharge device are provided on the downstream side of the traveling direction of the delivery chains 22*b*.

A wiping roller 19 of a wiping device 21 faces the intaglio cylinder 8 while being disposed in a wiping tank 20.

The operation of the intaglio printing press having the above-described arrangement will be explained next. The paper sheet 2 is fed from the sheet feeding device 3 onto the feeder board 4 one by one. The paper sheet 2 is transferred from the swing arm shaft pregripper 5 to the transfer cylinder 7 and then gripped by the grippers of the impression cylinder 6 and conveyed. The ink from each ink supply device 11 is transferred to the ink collecting cylinder 9 via a corresponding one of the pattern rollers 10 and supplied onto the intaglio plate surface of the intaglio cylinder 8.

An excess of ink (to be referred to as excess ink hereinafter) supplied onto the intaglio plate surface of the intaglio cylinder 8 is wiped by the wiping roller 19 of the wiping device 21 (cylinder cleaning device). When the paper sheet 2 passes between the impression cylinder 6 and the intaglio cylinder 8, the ink on the intaglio cylinder 8 is transferred to the paper sheet 2 to perform printing. Next, the paper sheet 2 is conveyed by the delivery chains 22*b* of the delivery device 22 via the delivery cylinder 27 and delivered onto the delivery tray 22*c*.

(2) Arrangement of Wiping Device

The wiping device 21 of the intaglio printing press will be described with reference to FIG. 2.

Figure 2:
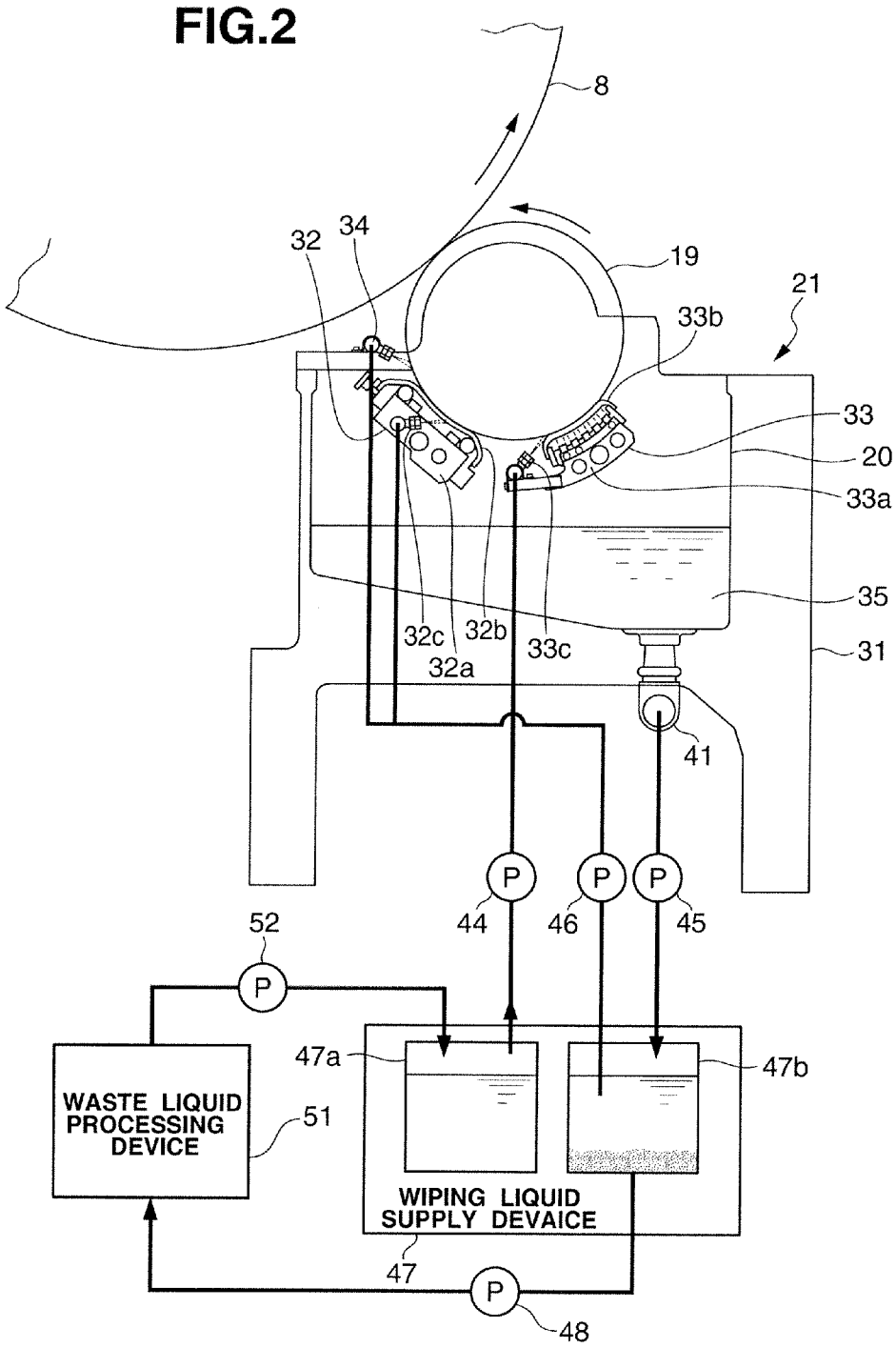
FIG. 2 is an enlarged side view of a wiping device shown in FIG. 1.

As shown in FIG. 2, the wiping device 21 shown in FIG. 1 includes a main body portion 31 for accommodating the wiping roller 19 in contact with the lower portion of the intaglio cylinder 8, a wiping liquid supply device 47 for supplying a wiping liquid for cleaning, a waste liquid processing device 51 for cleaning (regenerating) a waste wiping liquid generated at the time of cleaning of the wiping roller 19, and pumps 44 to 46, 48, and 52. The main body portion 31 includes the wiping tank 20 serving as a waste liquid tank, wiping pads 32 and 33 (ink removing devices) for removing excess ink adhered to the outer surface of the wiping roller 19, and a drain 41.

The wiping pad 32 is provided under the wiping roller 19 on the upstream side of the rotation direction. The wiping pad 33 is provided under the wiping roller 19 on the downstream side of the rotation direction. After wiping the excess ink adhered to the intaglio plate surface of the intaglio cylinder 8, the excess ink adhered to the surface of the wiping roller 19 is removed by the wiping pads 32 and 33.

The wiping pad 32 includes a pad main body 32*a* and a pad member 32*b* including a wire gauze, a sponge, and a metallic brush attached to the pad main body 32*a*. When the wiping pad 32 abuts against the rotating wiping roller 19, the excess ink adhered to the outer surface of the wiping roller 19 is removed by the pad member 32*b*.

The wiping pad 32 includes an injection nozzle 32*c* for injecting a wiping liquid containing caustic soda as a strong alkali to remove the excess ink adhered to the surface of the wiping roller 19. The injection nozzle 32*c* is attached to the side surface of the pad main body 32*a* so as to supply the wiping liquid to the outer surface of the wiping roller 19 from the rear surface side of the pad member 32*b*. The wiping liquid from the injection nozzle 32*c* is injected toward the contact surface between the pad member 32*b* and the wiping roller 19.

An external injection nozzle 34 for injecting the wiping liquid to the outer surface of the wiping roller 19 on the upstream side of the rotation direction of the wiping roller 19 with respect to the wiping pad 32 is attached to the main body portion 31 above the wiping pad 32. The wiping liquid from the external injection nozzle 34 is directly injected to the outer surface of the wiping roller 19.

Although the external injection nozzle 34 injects the wiping liquid on the upstream side of the rotation direction of the wiping roller 19 with respect to the wiping pad 32, the present invention is not limited to this. The wiping liquid may directly be injected to the contact portion between the wiping roller 19 and the pad member 32*b* of the wiping pad 32.

The wiping pad 33 is provided on the downstream side of the wiping roller 19 with respect to the wiping pad 32. The wiping pad 33 includes a pad main body 33*a* and a pad member 33*b* including a wire gauze, a sponge, and a metallic brush attached to the pad main body 33*a*. When the wiping pads 32 and 33 abut against the rotating wiping roller 19, the residual ink remaining after the excess ink has been removed by the pad member 32*b* is completely removed by the pad member 33*b*.

An injection nozzle 33*c* for injecting the wiping liquid is attached to the distal end of the pad main body 33*a* of the wiping pad 33. The attachment position of the injection nozzle 33*c* is on the downstream side of the rotation direction of the wiping roller 19 with respect to the injection nozzle 32*c* of the wiping pad 32 and on the upstream side of the rotation direction of the wiping roller 19 with respect to the pad member 33*b*. With this structure, the wiping liquid is injected from the injection nozzle 33*c* to the first contact surface between the pad member 33*b* and the wiping roller 19.

Although the wiping liquid is directly injected from the injection nozzle 33*c* to the contact portion between the pad member 33*b* and the wiping roller 19, the present invention is not limited to this. The wiping liquid may be injected from the injection nozzle 33*c* to the outer surface of the wiping roller 19 on the upstream side of the rotation direction with respect to the pad member 33*b*.

The wiping pad 32 injects the wiping liquid from two portions, that is, the injection nozzle 32*c* and the external injection nozzle 34 to the outer surface of the wiping roller 19. This is because the excess ink adhered to the surface of the wiping roller 19 needs to be dissolved by a large amount of wiping liquid for easier removal in the first cleaning stage by the wiping pad 32 arranged on the upstream side of the rotation direction of the wiping roller 19 with respect to the wiping pad 33.

The external injection nozzle 34, the injection nozzle 32*c*, and the injection nozzle 33*c* are sequentially disposed from the upstream side of the rotation direction of the wiping roller 19. The wiping liquid is supplied from the wiping liquid supply device 47 to the injection nozzle 33*c* of the wiping pad 33 via the pump 44 and to the external injection nozzle 34 and the injection nozzle 32*c* of the wiping pad 32 via the pump 46.

The external injection nozzle 34 and the injection nozzle 32*c* supply a large amount of wiping liquid to the outer surface of the wiping roller 19 to which the excess ink removed from the intaglio cylinder 8 adhered, thereby prompting to dissolve the excess ink. The injection nozzle 32*c* also injects the wiping liquid to the pad member 32*b* so as to prevent the pad member 32*b* from being clogged with the excess ink scraped from the outer surface of the wiping roller 19 and always maintain a high scraping effect.

The injection nozzle 33*c* acts to cause the wiping liquid to sufficiently damp the pad member 33*b* of the wiping pad 33 that performs finishing removal for removing the residue of the excess ink that could not be removed by the pad member 32*b*.

The wiping pad 32 performs coarse removal for scraping and removing the excess ink adhered to the surface of the wiping roller 19 for the first time. In this case, the scraping effect is high because the excess ink is dissolved by the large amount of wiping liquid supplied in advance from the external injection nozzle 34 and the injection nozzle 32*c*. Additionally, since the wiping liquid from the injection nozzle 32*c* prevents the pad member 32*b* from being clogged with the excess ink, a high scraping effect is always maintained as coarse removal.

The wiping pad 33 performs finishing removal for causing the pad member 33*b* to completely remove the residue of the excess ink removed by the pad member 32*b* of the wiping pad 32. In this case, the outer surface of the wiping roller 19 made of a resin is not only wiped but also polished while prompting to dissolve the residue of the excess ink by the wiping liquid. Note that after the finishing removal by the wiping pad 33, the wiping liquid adhered to the outer surface of the wiping roller 19 is removed by a doctor blade (not shown). After that, the excess ink adhered to the intaglio plate surface of the intaglio cylinder 8 is wiped.

For this reason, for the pad member 32*b* of the wiping pad 32, a coarse metallic brush or sponge is selected as the material suitable for the coarse removal. For the pad member 33*b* of the wiping pad 33, a finer metallic brush or sponge is selected as the material suitable for the finishing removal. The two pad members 32*b* and 33*b* may be made of the same material.

The wiping liquid supply device 47 includes a new liquid tank 47*a* for storing a wiping liquid to be used for cleaning, and a waste liquid tank 47*b* for storing a waste of the wiping liquid (to be referred to as a waste wiping liquid hereinafter). The new liquid tank 47*a* stores a wiping liquid purified for reuse or a newly purchased clean wiping liquid (to be referred to as a new wiping liquid hereinafter). The waste liquid tank 47*b* stores a waste wiping liquid for a predetermined time, thereby storing the waste wiping liquid separated into a supernatant liquid and a precipitate.

The wiping tank 20 of he main body portion 31 serves as a waste liquid tank that temporarily stores a waste wiping liquid 35 generated by removing the excess ink adhered to the surface of the wiping roller 19 using the wiping pads 32 and 33. The waste wiping liquid in the wiping tank is returned to the waste liquid tank 47*b* via the drain 41 and the pump 45.

When a predetermined time or more has elapsed, an ink component contained in the waste wiping liquid 35 stored in the waste liquid tank 47*b* precipitates so that the waste wiping liquid 35 is separated into a precipitate and a supernatant liquid. The separated supernatant liquid is drawn up by the pump 46 and supplied to the external injection nozzle 34 and the injection nozzle 32*c* of the wiping pad 32. On the other hand, the liquid (to be referred to as a precipitate liquid hereinafter) containing the precipitate of the waste wiping liquid 35 in the waste liquid tank 47*b* is discharged to the waste liquid processing device 51 via the pump 48.

The waste liquid processing device 51 filters and purifies the precipitate liquid of the waste wiping liquid 35 discharged from the waste liquid tank 47*b*, thereby recycling the purified wiping liquid from the precipitate liquid. The purified wiping liquid is returned to the new liquid tank 47*a* of the wiping liquid supply device 47 via the pump 52.

In this embodiment, the waste wiping liquid 35 is reused via the waste liquid tank 47*b* or via the waste liquid tank 47*b* and the waste liquid processing device 51 without being directly discarded. This allows to efficiently clean the wiping roller 19 while omitting any cumbersome operation such as refill of the wiping liquid or discard of the waste wiping liquid 35.

(3) Operation of Wiping Device

In the wiping device 21 having the above-described arrangement, a large amount of wiping liquid is supplied, using both the external injection nozzle 34 and the injection nozzle 32*c*, to the excess ink removed from the intaglio cylinder 8 by the wiping roller 19. The excess ink is coarsely removed by the pad member 32*b* of the wiping pad 32 while quickly prompting to dissolve the excess ink as compared to a case in which only the injection nozzle 32*c* is used.

Simultaneously, the injection nozzle 32*c* injects the wiping liquid to the pad member 32*b* of the wiping pad 32. This prevents the pad member 32*b* from being clogged with the excess ink scraped from the outer surface of the wiping roller 19 and maintains a high scraping effect.

Next, the injection nozzle 33*c* injects the wiping liquid to the pad member 33*b* of the wiping pad 32 for finishing removal. The pad member 33*b* sufficiently damped with the wiping liquid wipes the outer surface of the wiping roller 19, thereby performing finishing removal.

At this time, since the wiping pad 32 is used for coarse removal of the excess ink, the supernatant liquid of the waste wiping liquid 35 is supplied from the waste liquid tank 47*b* of the wiping liquid supply device 47 to the external injection nozzle 34 and the injection nozzle 32*c*. The pad member 32*b* of the wiping pad 32 thus performs coarse removal using the supernatant liquid of the waste wiping liquid 35.

On the other hand, since the wiping pad 33 is used for finishing removal of the residue of the excess ink, the clean wiping liquid is supplied from the new liquid tank 47*a* of the wiping liquid supply device 47 to the injection nozzle 33*c*. The pad member 33*b* of the wiping pad 33 thus performs finishing wiping using the clean wiping liquid.

The wiping pad 32 coarsely removes the excess ink adhered to the surface of the wiping roller 19 using a large amount of supernatant liquid of the inexpensive waste wiping liquid 35. Since the wiping pad 32 does not use the clean wiping liquid in the new liquid tank 47*a*, consumption of the expensive clean wiping liquid can be suppressed.

On the other hand, the wiping pad 33 completely removes the residue of the removed excess ink using the clean wiping liquid supplied from the new liquid tank 47*a* of the wiping liquid supply device 47 as much as needed.

According to this embodiment, the wiping device 21 of the intaglio printing press supplies a large amount of supernatant liquid of the waste wiping liquid 35 from both the external injection nozzle 34 and the injection nozzle 32*c* to the excess ink adhered to the outer surface of the wiping roller 19. The wiping pad 32 thus performs coarse removal while quickly prompting to dissolve the excess ink. After that, the clean wiping liquid is supplied from the injection nozzle 33*c* to the residue of the excess ink on the outer surface of the wiping roller 19. The wiping pad 33 wipes the outer surface of the wiping roller 19 to perform finishing removal to remove the residue of the excess ink sufficiently damped with the wiping liquid.

The large amount of wiping liquid that is necessary for the coarse removal and is supplied to the wiping pad 32 via the external injection nozzle 34 and the injection nozzle 32*c* is ensured from the supernatant liquid of the waste wiping liquid 35. Since it is unnecessary to use the clean wiping liquid for the coarse removal of the excess ink, the intaglio cylinder 8 can properly be cleaned at low cost.

The waste wiping liquid 35 is separated into a precipitate and a supernatant liquid in the waste liquid tank 47*b* of the wiping liquid supply device 47, and the supernatant liquid is reused for coarse removal of the excess ink. This allows to circulate and reuse the wiping liquid without providing the waste liquid processing device 51.

(4) Expansion Example

In the above-described embodiment, a large amount of supernatant liquid of the waste wiping liquid 35 is supplied from the two nozzles 32*c* and 34 to the wiping pad 32. However, a large amount of supernatant liquid may be supplied via one or three or more injection nozzles.

In the above-described embodiment, after the waste wiping liquid 35 is separated into a precipitate and a supernatant liquid in the waste liquid tank 47*b*, the supernatant liquid is supplied to the wiping pad 32. However, the present invention is not limited to this. Instead of providing the waste liquid tank 47*b*, the waste wiping liquid 35 may be stored in the wiping tank 20 for a predetermined time, and a resultant supernatant liquid may be supplied to the wiping pad 32. When the waste liquid tank 47*b* is provided, the supernatant liquid from it and the supernatant liquid for the wiping tank 20 may be supplied to the wiping pad 32.

What is claimed is:

1. A wiping device comprising:

an intaglio cylinder rotatably supported;

a cylinder cleaning device that removes excess ink adhered to an outer surface of said intaglio cylinder; and a wiping liquid supply device that supplies a wiping liquid for cleaning to said cylinder cleaning device, said wiping liquid supply device comprising:

a waste liquid tank that stores a waste wiping liquid discharged from said cylinder cleaning device;

a new liquid tank that stores a clean wiping liquid;

a first pump that supplies the clean wiping liquid fro said new liquid tank to said cylinder cleaning device; and a second pump that directly supplies a supernatant liquid of the waste wiping liquid stored in said waste liquid tank and separated into a precipitate and the supernatant liquid to said cylinder cleaning device.

2. The device according to claim 1, further comprising:

a waste liquid processing device that purifies the precipitate of the waste wiping liquid in said waste liquid tank, thereby recycling the wiping liquid; and a third pump that returns the wiping liquid recycled by said waste liquid processing device to said new liquid tank,

3. The device according to claim l, wherein said cylinder cleaning device comprises:

a wiping roller that comes into contact with said intaglio cylinder so as to wipe the excess ink of ink adhered to the outer surface of said intaglio cylinder;

an ink removal device that removes the excess ink on an outer surface of said wiping roller; and a wiping tank that temporarily stores the waste wiping liquid generated upon removing the excess ink.

4. The device according to claim 3, wherein said ink removal device comprises:

a first wiping pad provided on an upstream side of a rotation direction of said wiping roller so as to abut against the outer surface of said wiping roller; and a second wiping pad provided on a downstream side of the rotation direction of said wiping roller with respect to said first wiping pad so as to abut against the outer surface of said wiping roller, the clean wiping liquid in said new liquid tank is supplied, via said first pump, to at least one of said second wiping pad and the outer surface of said wiping roller near said second wiping pad, and the supernatant liquid in said waste liquid tank is supplied, via said second pump, to at least one of said first wiping pad and the outer surface of said wiping roller near said first wiping pad.

5. The device according to claim 4, further comprising:

a first injection nozzle attached in state of being oriented to said first wiping pad so as to in inject the supernatant liquid in said waste liquid tank via said second pump;

a second injection nozzle attached in state of being oriented to at least one of said second wiping pad and the outer surface of said wiping roller near said second wiping pad so as to inject the clean wiping liquid in said new liquid tank via said first pump; and a third injection nozzle attached in state of being oriented to the outer surface of said wiping roller on an upstream side of a rotation direction with respect to said first wiping pad so as to inject the supernatant liquid in said waste liquid tank via said second pump.

* * * * *

UNITED STATES PATENT AND TRADEMARK OFFICE

CERTIFICATE OF CORRECTION

PATENT NO. : 8,939,077 B2
APPLICATION NO. : 13/570200
DATED : January 27, 2015
INVENTOR(S) : Norihiro Kumagai It is certified that error appears in the above-identified patent and that said Letters Patent is hereby corrected as shown below:

In the Claims,

Column 7, Claim 1, line 41, please delete “fro” and insert --from--.

Signed and Sealed this
Fifteenth Day of September, 2015

Michelle K. Lee

Michelle K. Lee
*Director of the United States Patent and Trademark Office*